US008082999B2

(12) United States Patent
Renshaw et al.

(10) Patent No.: US 8,082,999 B2
(45) Date of Patent: Dec. 27, 2011

(54) DRILLING AND COMPLETION DEFLECTOR

(75) Inventors: William Shaun Renshaw, Edmonton (CA); Rob McCullough, Spruce Grove (CA)

(73) Assignee: Halliburton Energy Services, Inc., Houston, TX (US)

( * ) Notice: Subject to any disclaimer, the term of this patent is extended or adjusted under 35 U.S.C. 154(b) by 205 days.

(21) Appl. No.: 12/389,433

(22) Filed: Feb. 20, 2009

(65) Prior Publication Data

US 2010/0212913 A1 Aug. 26, 2010

(51) Int. Cl.

| | |
|---|---|
| ***E21B 23/00*** | (2006.01) |
| ***E21B 7/06*** | (2006.01) |
| ***E21B 7/08*** | (2006.01) |
| ***E21B 23/03*** | (2006.01) |
| ***E21B 23/12*** | (2006.01) |
| ***E21B 31/14*** | (2006.01) |

(52) U.S. Cl. ..... 166/381; 166/117.6

(58) Field of Classification Search ..... 166/381, 166/382, 117.6, 117.5, 377; 175/61
See application file for complete search history.

(56) References Cited

U.S. PATENT DOCUMENTS

| | | | | |
|---|---|---|---|---|
| 5,425,419 | A * | 6/1995 | Sieber | 166/206 |
| 5,467,819 | A * | 11/1995 | Braddick | 166/117.6 |
| 5,474,126 | A * | 12/1995 | Lynde et al. | 166/117.6 |
| 5,787,978 | A * | 8/1998 | Carter et al. | 166/117.6 |
| 6,019,173 | A * | 2/2000 | Saurer et al. | 166/98 |
| 2002/0020562 | A1 * | 2/2002 | Baird | 175/78 |
| 2008/0029276 | A1 * | 2/2008 | Templeton et al. | 166/385 |
| 2009/0255661 | A1 | 10/2009 | Clark et al. | |
| 2009/0255664 | A1 | 10/2009 | Hart et al. | |

FOREIGN PATENT DOCUMENTS

WO 2009129116 A2 10/2009

OTHER PUBLICATIONS

Steele, David J., and Deshmukh, Aditya Shailesh, Patent Application entitled, "Combination Whipstock and Completion Deflector," filed Nov. 4, 2010, U.S. Appl. No. 12/939,223.

Renshaw, William Shaun, et al., Patent Application entitled "Drilling and Completion Deflector and Method of Using," filed Aug. 11, 2011, U.S. Appl. No. 13/207,499.

* cited by examiner

*Primary Examiner* — David Bagnell
*Assistant Examiner* — Cathleen Hutchins
(74) *Attorney, Agent, or Firm* — Michael W. Piper

(57) ABSTRACT

A tool assembly is provided. The tool assembly comprises a drilling deflector and a completion deflector, the completion deflector coupled to the drilling deflector.

16 Claims, 5 Drawing Sheets

DRILLING AND COMPLETION DEFLECTOR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A plurality of wellbores may be drilled from a single position, for example from an offshore drilling platform. A first wellbore may be drilled and a casing set in the first wellbore. Thereafter a window may be cut in the casing at a location for initiating a lateral wellbore and a lateral junction may be placed in the window.

To initiate a lateral wellbore, a drilling deflector tool, for example a first whipstock, may be attached to a workstring and run-in during a first trip into the wellbore and set at a first position for deflecting a cutting tool into the casing to cut the window and initiate the lateral wellbore. The workstring may be withdrawn during a first trip out of the wellbore. A cutting tool may be attached to the workstring and run-in during a second trip into the wellbore and the window cut in the casing. The cutting tool may then be withdrawn during a second trip out of the wellbore. A retrieval tool may be attached to the workstring and run-in during a third trip into the wellbore to couple to the drilling deflector tool. The retrieval tool and the drilling deflector tool may then be withdrawn during a third trip out of the wellbore. A completion deflector tool, for example a second whipstock, may be attached to the workstring and run-in during a fourth trip into the wellbore and set at a second position for deflecting a completion tool into the window. The workstring may then be withdrawn during a fourth trip out of the wellbore.

A completion tool may be attached to the workstring and run-in during a fifth trip into the wellbore. The completion tool may be set in the window, for example establishing a lateral junction. The completion tool may be a screen or some other contrivance to prevent undesired entrance of solids and/or fluids from a formation proximate to the window into either the wellbore or the lateral wellbore. The junction may be in conformance with one of the levels defined by the technology advancement for multilaterals (TAML) organization, for example a TAML Level 5 multilateral junction. The workstring may be withdrawn from the wellbore during a fifth trip out of the wellbore. A drilling tool may be attached to the workstring and run-in during a sixth trip into the wellbore. Drilling in the lateral wellbore may then be continued.

In some drilling environments, for example offshore drilling platforms located in the North Sea and/or off the coast of Australia, operating costs of drilling rigs may be in the range from $500,000 per day to over $1,000,000 per day.

SUMMARY

In an embodiment, a tool assembly is disclosed. The tool assembly comprises a drilling deflector and a completion deflector, the completion deflector coupled to the drilling deflector. In an embodiment, the coupling between the drilling deflector and the completion deflector comprises a portion of the drilling deflector nesting within a portion of the completion deflector. In an embodiment, an interior of the completion deflector defines a first recess, and the drilling deflector comprises a catch that engages the first recess in a run-in state of the tool assembly and that releases from the first recess when in a completion state of the tool assembly. In an embodiment, the catch comprises one of a collet, an eccentric cam, and a pin. In an embodiment, the drilling deflector comprises an axial hollow, wherein the completion deflector comprises an axial hollow, and wherein the axial hollow of the drilling deflector aligns with the axial hollow of the completion deflector. In an embodiment, the tool assembly further comprises an anchor coupled to the completion deflector. In an embodiment, the tool assembly further comprises a retainer, an exterior of the anchor comprises a second recess, an interior of the completion deflector comprises a third recess, and the retainer is captured by the second recess and the third recess in a completion state of the tool assembly.

In an embodiment, a method of servicing a wellbore is disclosed. The method comprises retrieving a drilling deflector located proximate to a window in the wellbore from the wellbore while a completion deflector is also located in the wellbore and shifting the completion deflector to a position proximate to the window. In an embodiment, a portion of the drilling deflector is nested within a portion of the completion deflector before retrieving the drilling deflector, and shifting the completion deflector to the position proximate to the window is motivated by retrieving the drilling deflector. In an embodiment, the method further comprises the completion deflector retaining the drilling deflector after run-in of the drilling deflector and before the completion deflector is shifted to the position proximate to the window, and the completion deflector releasing the drilling deflector when the completion deflector is shifted to the position proximate to the window. In an embodiment, the method further comprises an anchor component retaining the completion deflector when the completion deflector is shifted to the position proximate to the window. In an embodiment, retrieving the drilling deflector comprises applying upwards force on the drilling deflector while downwards force is applied to the anchor component. In an embodiment, the completion deflector retaining the drilling deflector comprises the anchor component propping a collet of the drilling deflector.

In another embodiment, another method of servicing a wellbore is disclosed. The method comprises running a tool assembly comprising a drilling deflector and a completion deflector into the wellbore and retrieving the drilling deflector from the wellbore while leaving the completion deflector in the wellbore. In an embodiment, the method further comprises moving the drilling deflector to move the completion deflector to a position proximate to a window in the wellbore. In an embodiment, the tool assembly further comprises an anchor component, and retrieving the drilling deflector comprises a retrieval tool retaining the drilling deflector, the retrieval tool extending a member through the drilling deflector, and the completion deflector, and the retrieval tool exerting downwards force via the member on the anchor. In an embodiment, the method further comprises a retrieval tool retaining the drilling deflector by actuating a catch of the retrieval tool to engage a recess defined by the drilling deflector. In an embodiment, retrieving the drilling deflector comprises the completion deflector retaining the drilling deflector during a first portion of retrieving the drilling deflector and comprises the completion deflector releasing the drilling deflector during a second portion of retrieving the drilling deflector. In an embodiment, the method further comprises shifting the drilling deflector and the completion deflector together upwards. In an embodiment, a portion of the drilling deflector nests within the completion deflector while running the tool assembly into the wellbore, and the method further comprises unnesting the portion of the drilling deflector from the completion deflector after the completion deflector has been shifted into a position proximate to a window in the wellbore.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
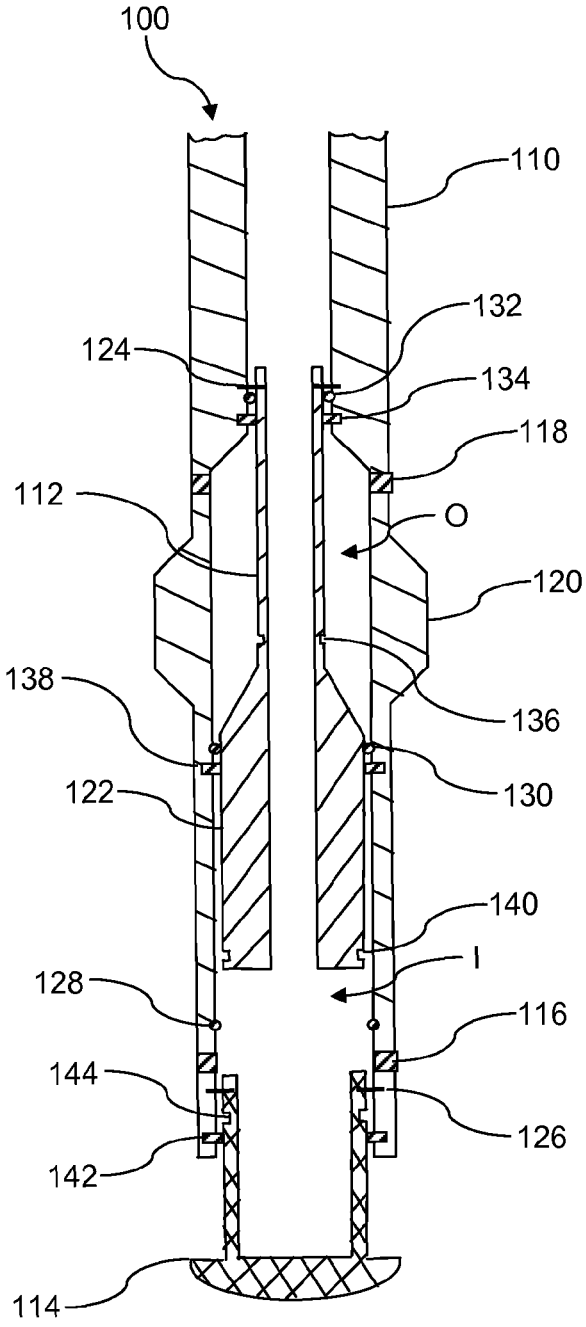
FIG. 1A illustrates a retrieval tool according to an embodiment of the present disclosure.

It should be understood at the outset that although illustrative implementations of one or more embodiments are described below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

A tool assembly and a corresponding retrieval tool are taught by the present disclosure. In an embodiment, the tool assembly comprises a completion deflector component and a drilling deflector component. In another embodiment, the tool assembly may further comprise an anchor component. In some contexts, the deflector components may be referred to as whipstock components. The tool assembly is adapted for setting in a wellbore, for example a main wellbore and/or a parent wellbore.

The drilling deflector is adapted for guiding a cutting tool to cut a window in a wall of the main wellbore to initiate a lateral wellbore off of the main wellbore, for example cutting a window in a wall of a casing string that may be cemented in the main wellbore. In an embodiment, the drilling deflector may comprise one or more surfaces that are surface hardened to resist the abrasion and/or cutting action of cutting tools and/or drilling tools. In an embodiment, the drilling deflector may comprise one or more inserts that resist the abrasion and/or cutting action of cutting tools and/or drilling tools. In an embodiment, the inserts may comprise tungsten carbide inserts or other hardened inserts. In an embodiment, tungsten carbides or other hardened objects may be braised or otherwise coupled to a surface of the drilling deflector to resist the abrasion and/or cutting action of cutting tools and/or drilling tools. In an embodiment, a portion of the drilling deflector may be shaped to redirect a downwards force on a cutting tool and/or drilling tool sideways into a casing wall to cut a window in the casing wall or into a formation proximate to the window. For example, the drilling deflector may have a surface that is not perpendicular to the wellbore but is oriented to define a non-right angle (an angle that is not a right angle) with the axis of the wellbore. The drilling deflector may be fabricated to define different angles depending upon different intended wellbore environments. In some embodiments, the upper surface may define a curved surface that generally redirects a downwards force of a cutting tool and/or drilling tool sideways into a casing wall or into a formation proximate a window cut in the casing wall. In some contexts, the drilling deflector may be referred to as a whipstock or a drilling whipstock. In an embodiment, the drilling deflector may define an axial hollow or aperture that extends from the top surface through to the bottom surface of the drilling deflector.

The completion deflector is adapted for guiding a completion tool into and/or through the window. For example, in an embodiment, the completion deflector may guide a multilateral junction completion tool into the window in the wellbore. In an embodiment, the completion deflector may further serve to guide tools through the window in the wellbore to work further in the lateral wellbore. In an embodiment, the completion deflector may have a surface, referred to as a deflection surface, that is angled to deflect a completion tool sideways, through and/or into the window. For example, the deflection surface may define a non-right angle (an angle that is not a right angle) with an axis of the wellbore. In an embodiment, the deflection surface may be curved to define generally a non-right angle with the axis of the wellbore. In an embodiment, the completion deflector may define an axial hollow or aperture that extends from a top surface through to a bottom surface of the completion deflector In an embodiment, the tool assembly is adapted for saving one round trip—an in-hole trip and an out-of-hole trip—with respect to the known methods of cutting windows, setting completion devices in the casing windows, and working in lateral wellbores. Reducing the number of trips needed to complete the multilateral junction may save rig operating costs. Additionally, reducing the amount of time the multilateral junction is open by reducing the number of trips needed to complete the multilateral junction, for example when the main wellbore is cased, may reduce the amount of debris and other materials from the formation proximate to the window in the casing that may propagate into the main wellbore. In other embodiments, the tool assembly may serve other purposes and/or provide other advantages.

In an embodiment, the retrieval tool is adapted to couple to the drilling deflector when run-in and bottomed out against the downhole oilfield tool assembly and when actuated by a motivating force provided from the surface. In an embodiment, motivating force may be provided by hydraulic pressure applied to the interior of the retrieval tool, for example hydraulic pressure from circulation fluid supplied from the surface via a workstring to which the retrieval tool is coupled. In an embodiment, the retrieval tool maintains downward force on the anchor component via a plug component or a member of the retrieval tool while lifting and shifting upwards the drilling deflector and the completion deflector. In an embodiment, the plug component of the retrieval tool may extend through the drilling deflector and through the completion deflector to engage the anchor component and apply downwards force on the anchor component. In an embodiment, the downwards force exerted by the plug on the latch is motivated by hydraulic pressure supplied by the workstring to the interior of the retrieval tool, as described in greater detail hereinafter. When the completion deflector has shifted to a position effective to promote deflection of a completion tool into the window, the completion deflector is retained in the position, for example by a retainer retained by a first retainer recess in the anchor component engaging a second retainer recess in the completion deflector. By continued lifting up on the workstring while maintaining hydraulic pressure to the interior of the retrieval tool, the retrieval tool continues to apply downward force on the anchor component via the plug component while applying upwards force on the drilling deflector, pulling the drilling deflector free of the completion deflector. The drilling deflector may then be withdrawn from the wellbore.

Turning now to FIG. 1A, a retrieval tool 100 is described. In the following descriptions directional terms such as "upper," "lower," "upward," "downward," etc., are used in relation to the retrieval tool 100 as it is depicted in the figures. It is understood that the retrieval tool 100 may be utilized in vertical, horizontal, inverted, or inclined orientations without departing from the teachings of the present disclosure. The retrieval tool 100 comprises a body 110, a piston 112, and a plug 114. In an embodiment, the body 110 is substantially tubular in shape. An upper portion of the body 110 is adapted for coupling to a workstring. In an embodiment, the upper portion of the body 110 may have a threaded coupling for threading into the workstring.

In an embodiment, the upper portion of the body 110 has a first inside diameter, and a lower portion and a middle portion of the body 110 have a second inside diameter, where the second inside diameter is greater than the first inside diameter. The transition from the first inside diameter to the second inside diameter defines a shoulder of the body 110. The piston 112 comprises an upper portion having a first outside diameter and a lower portion having a second outside diameter, where the second outside diameter is greater than the first outside diameter. The transition from the first outside diameter to the second outside diameter defines a shoulder of the piston 112. In other embodiments, the body 110 and the piston 112 may have different configurations and/or forms. The plug 114 comprises a sleeve portion.

When assembled for deployment into a wellbore, the upper portion of the piston 112 is received by the upper portion of the body 110, the lower portion of the piston 112 is received by the lower and middle portions of the body 110, and the sleeve portion of the plug 114 is received by the lower portion of the body 110. In an embodiment, when assembled for deployment into the wellbore, the piston 112 is coupled to the body 110 by one or more first shear pin 124, and the plug 114 is coupled to the body 110 by one or more second shear pin 126. In another embodiment, however, other means may be employed for coupling the body 110, the piston 112, and the plug 114 together as an assembly before and during deployment into the wellbore. For example, an effective amount of sliding friction between the piston 112 and the body 110 and between the plug 114 and the body 110 may be employed to maintain the run-in configuration of the retrieval tool 100 before and during deployment into the wellbore. In an embodiment, the piston 112 further comprises an axial port or passage that provides fluid communication, when the retrieval tool 100 is assembled for deployment into a wellbore, from the upper interior of the body 110 and, upwards of the body 110, from the interior of the workstring to the lower interior of the body 110.

In an embodiment, the body 110 comprises one or more first port 116 in a lower portion of the body 110, one or more second port 118 in a middle portion of the body 110, and a catch 120 in a middle portion of the body 110. The first port 116 provides fluid communication between a first chamber I of the body 110 and an exterior of the body 110 in a run-in state of the retrieval tool 100. The second port 118 provides fluid communication between a second chamber O defined between the shoulder of the body 110, the interior of the body 110, the shoulder of the piston 112, and the exterior of the piston 112. The port 116 may have any shape and size effective for substantially equalizing fluid pressure between an exterior of the body 110 and the chamber I during the run-in state. The port 118, similarly, may have any shape and size effective for substantially equalizing fluid pressure between the exterior of the body 110 and the chamber O.

The catch 120 is adapted for controllably engaging and retaining a tool to be retrieved from the wellbore. The catch 120 may be implemented by a variety of mechanical structures including a collet, a rotating eccentric cam, a pin, and other structures that promote controllable radial expansion of a rigid structure to engage and retain a recess, a groove, or an interior ridge or rim of a tool to be retrieved. In an embodiment, the catch 120 is actuated by the piston 112 being driven upwards by a hydraulic pressure differential between the chamber I and the chamber O.

Figure 1B:
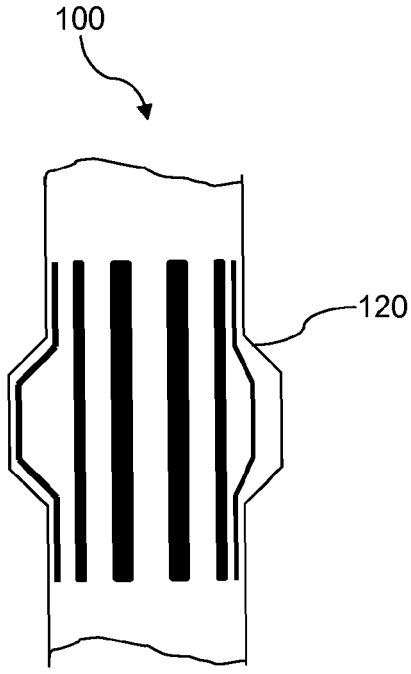
FIG. 1B illustrates a collet portion of the retrieval tool according to an embodiment of the disclosure.

In an embodiment, for example as illustrated in FIG. 1B, the catch 120 is a collet and has a shape and size adapted for engaging and retaining a collet groove defined by an interior of a drilling deflector to be described in greater detail hereinafter. The collet may be formed by any of a variety of known manufacturing and/or machining processes. Any number of apertures and/or slots may be provided in the collet. Any ratio of open space versus filled space may be provided around the circumference of the collet. When the retrieval tool 100 is in the run-in condition, the collet is unpropped and/or unsupported and the collet may be compressed. For example, the collet while unpropped may be compressed to slide into a collet groove adapted for receiving the retrieval tool 100 and the collet. When the retrieval tool 100 is in an engaged state, a propping area 122 of the piston 112, for example the lower portion of the piston 112, is moved upwards to prop and/or support the collet. While propped by propping area 122, the collet may not be compressed and retains the downhole oilfield tool to be retrieved from the wellbore, for example the drilling deflector.

In another embodiment, the catch 120 may be implemented as one or more rotating eccentric cam, wherein the lobe of the cam is retracted within the outside diameter of the body 110 in an unactuated state, and the lobe of the cam protrudes beyond the outside diameter of the body 110 in an actuated state, engaging and retaining a recess and/or groove of the tool that is to be retrieved. A gear coupled to the eccentric cam may engage a linear toothed gear coupled to or defined by the piston 112. In another embodiment, the catch 120 may be implemented as one or more pins biased to a retracted position within a recess of the body 110 in an unactuated state and driven to protrude outside of the body 110 in an actuated state, to engage and retain a recess and/or groove of the tool to be retrieved. The pin may be driven outwards by a ramp shaped portion or shoulder of the piston 112.

In an embodiment, a first seal 130 between the body 110 and the lower portion of the piston 112 and a second seal 132 between the body 110 and the upper portion of the piston 112 promotes pressure isolation between the chamber I and the chamber O. In an embodiment, a third seal 128 is provided between the body 110 and the plug 114 when the plug 114 has shifted upwards, for example when the retrieval tool 100 has bottomed out against a downhole oilfield tool in the wellbore. In an embodiment, the seals 128, 130, 132 may be provided by O-ring type seals, but in another embodiment another kind of seal may be used.

In an embodiment, a first retainer 134 is retained by a corresponding retainer recess in the interior of the upper portion of the body 110, and a second retainer 138 is retained by a corresponding retainer recess in the interior of the middle portion of the body 110. During a change of state of the retrieval tool 100 from the run-in state to the engaged state, the piston 112 slides upwards, the retainers 134, 138 sliding over the outside of the upper portion and the lower portion of the piston 112 respectively. When the piston 112 slides sufficiently upwards, the first retainer 134 engages and is retained by a first retainer recess 136 defined by the exterior of the upper portion of the piston 112, and the second retainer 138 engages and is retained by a second retainer recess 140 defined by the exterior of the lower portion of the piston 112. When the retainers 134, 138 are retained by the retainer recesses 136, 140, the piston 112 is retained in a fixed position, and the retrieval tool 100 is in the engaged state.

The retainers 134, 138 may be implemented as a variety of structures including retainer rings, C-rings, and biased pins or lugs or metal balls. The retainer recesses may be implemented as any of a variety of structures including grooves, slots, detents, and other kinds of recesses. In an embodiment, the engagement of the retainers in the retainer recesses may depend upon a rotational alignment of the piston 112 within the body 110. In an embodiment, a longitudinal land or raised rim defined by the outside of the piston 112 may engage a longitudinal groove or slot defined by the inside of the body 110 to maintain a desired rotational alignment of the piston 112 with the body 110. Alternatively, a longitudinal land or raised rim defined by the inside of the body 110 may engage a longitudinal groove or slot defined by the exterior of the piston 112 to maintain a desired rotational alignment of the piston 112 with the body 110. In the engaged state of the retrieval tool 100, the catch 120 is actuated, for example, in an embodiment the propping area 122 props the collet.

In an embodiment, a third retainer 142 is retained by a corresponding retainer recess in the interior of the lower portion of the body 110. When the retrieval tool 100 is retrieving the tool from the wellbore, for example the drilling deflector, the sleeve portion of the plug 114 slides downwards, the third retainer 142 sliding over the outside of the sleeve of the plug 114. When the plug 114 slides sufficiently downwards, the third retainer 142 engages and is retained by a third retainer recess 144 defined by the exterior of the sleeve portion of the plug 114. The third retainer 142 may be implemented by a variety of structures including retainer rings, C-rings, and biased pins or lugs or metal balls. The retainer recesses may be implemented by a variety of structures including grooves, slots, detents, and other recesses. In an embodiment, the engagement of the third retainer 142 with the retainer recesses may depend upon a rotational alignment of the plug 114 with the body 110. In an embodiment, the desired rotational alignment of the plug 114 with the body 110 may be maintained by engagement of a longitudinal land defined by the outside of the sleeve of the plug 114 with a longitudinal groove defined by the inside of the lower portion of the body 110. Alternatively, in an embodiment, the desired rotational alignment of the plug 114 with the body 110 may be maintained by engagement of a longitudinal land defined by the inside of the body 110 with a longitudinal groove defined by the outside of the sleeve of the plug 114.

In an embodiment, when the retrieval tool 100 is deployed into the wellbore and bottoms out against the tool to be retrieved from the wellbore, the plug 114 contacts the tool, the downwards force on the retrieval tool 100 exerted by the workstring shears the shear pin 126, and the plug 114 slides upwards, sliding the sleeve of the plug 114 into sealing contact with the first seal 128. In this position, the sleeve of the plug 114 blocks the first port 116. During run-in of the retrieval tool 100, circulation fluid may be flowed down the workstring, through the axial port of the piston 112, into chamber 1, out the first port 116, into the wellbore, and up an annulus formed between the workstring and the wellbore. Alternatively, circulation fluid may not be flowed down the workstring. In an embodiment, circulation down the workstring may flow during most of the run-in but may stop when the retrieval tool 100 is judged to be approaching the tool to be retrieved.

When the sleeve of the plug 114 blocks the first port 116, a hydraulic pressure differential may build up between the chamber I and the chamber O, driving the piston 112 upwards with sufficient force to shear the second shear pin 124, sliding the piston 112 upwards until the retainer rings 134, 138 engage and are retained by the retainer grooves 136, 140 respectively. When the piston 112 is driven upwards, the catch 120 is actuated, for example the propping area 122 props the collet, engaging the collet to retain the tool to be retrieved. Alternatively, the piston 112 actuates the other forms of the catch 120 as the piston 112 is driven upwards. This configuration of the retrieval tool 100 may be referred to as the engaged state.

When the retrieval tool 100 is in the engaged state, the retrieval tool 100 may be retrieved from the wellbore, withdrawing the tool to be retrieved. In an embodiment, the tool to be retrieved may be a component of a multi-component tool assembly. As the retrieval tool 100 is moved upwards, the catch 120 exerts upwards force on the tool to be retrieved, the hydraulic pressure in the chamber I is maintained and drives the plug 114 downwards, thereby exerting a downwards force on at least one component of the multi-component tool assembly. In some contexts, the plug 114 may be referred to as a member or an extended member. As the retrieval tool 100 is moved upwards, the plug 114 remains bottomed out against at least one component of the multi-component tool assembly, the sleeve of the plug 114 sliding along the inside of the lower portion of the body 110. After the tool to be retrieved has been freed from the multi-component tool assembly, the third retainer 142 engages and is retained by the plug retainer recess 144, preventing further sliding downwards of the plug 114. When the third retainer 142 engages the plug retainer recess 144, the sleeve of the plug 114 has slid below the first port 116, unblocking the first port 116. As the retrieval tool 100 and retained tool are withdrawn from the wellbore, circulation fluid may be circulated from the surface through the workstring, through the axial port of the piston 112, and out the first port 116.

Figure 2:
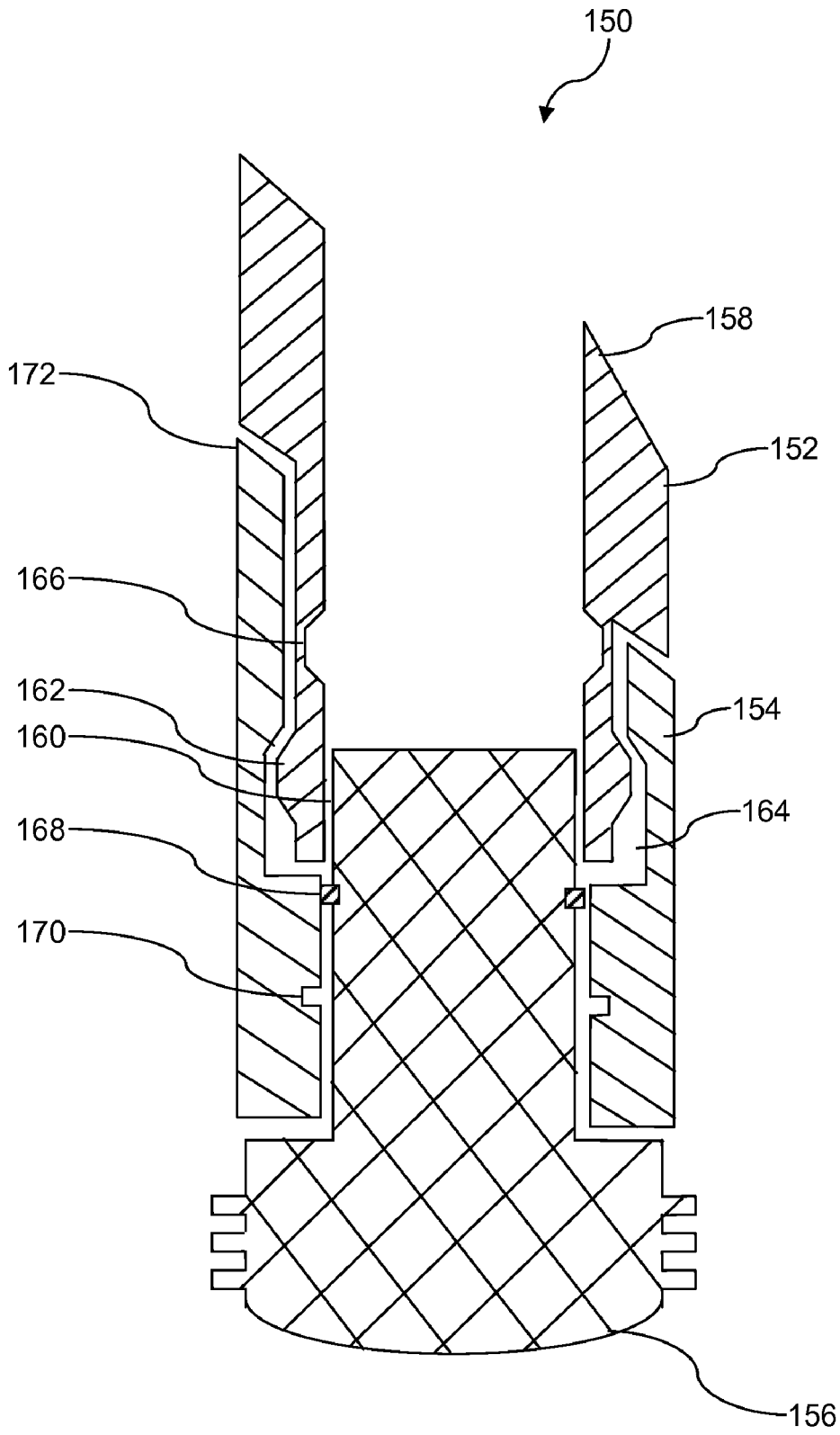
FIG. 2 illustrate s a tool assembly in a run-in state according to an embodiment of the disclosure.

Turning now to FIG. 2, a tool assembly 150 is described. In the following descriptions directional terms such as "upper," "lower," "upward," "downward," etc., are used in relation to the tool assembly 150 as it is depicted in the figures. It is understood that the tool assembly 150 may be utilized in vertical, horizontal, inverted, or inclined orientations without departing from the teachings of the present disclosure. In an embodiment, the tool assembly 150 comprises a drilling deflector 152 and a completion deflector 154. In some embodiments, the tool assembly 150 may further comprise an anchor component 156, but in other embodiments the tool assembly 150 does not include the anchor component 156. In other embodiments, the tool assembly 150 may comprise other components. In an embodiment, the anchor component 156 comprises a shaft 160 that is received by the completion deflector 154. In some contexts, the shaft 160 may be said to nest within or inside of a lower portion of the completion deflector 154. The lower portion of the drilling deflector 152 is received by the completion deflector 154. In some contexts, the lower portion of the drilling deflector 152 may be said to nest within or inside of an upper portion of the completion deflector 154.

The completion deflector 154 comprises an upper portion 172 having a first surface that generally defines a first angle adapted for guiding a completion tool into a window in the wall of the wellbore, for example a window in a casing wall of a cased wellbore. For example, the first angle redirects a downwards force exerted on the completion tool by a workstring sideways, moving the completion tool into and/or through the window in the casing. The first angle makes a non-right angle with an axis of the wellbore when the tool assembly 150 is run-in. The first surface may be a curved surface and may be said to define the first angle as an average or mean across the first surface. The drilling deflector 152 has an upper portion 158 having a second surface that generally defines a second angle adapted for guiding a tool to cut the window in the wall of the wellbore and to initiate a lateral wellbore off of the wellbore. For example, the second angle redirects a downwards force exerted on a window cutting tool by a workstring sideways, causing the cutting tool to cut into the casing to cut a window in the casing. The second angle makes a non-right angle with the axis of the wellbore when the tool assembly 150 is run-in. The second surface may be a curved surface and may be said to define the second angle as an average or mean across the second surface. In some embodiments the first and second angles may be substantially equal, but in other embodiments the first angle may differ from the second angle. In an embodiment, the second surface, which in some contexts may be referred to as a deflection surface, of the drilling deflector 152 may be adapted to resist abrasion and/or erosion by drilling and/or cutting operations. For example, the second surface may be surface hardened or may be fabricated with hardened components, for example tungsten carbides braised or otherwise affixed to the second surface or by replaceable tungsten carbides inserted into recesses in the second surface and retained in position by screws, bolts, or the like.

In an embodiment, the drilling deflector 152 defines an axial hollow, cavity, or aperture. In an embodiment, the completion deflector 154 defines an axial hollow, cavity, or aperture. In an embodiment, when engaging and retaining the drilling deflector 152, the plug 114 of the retrieval tool 100 extends through the axial hollows of the drilling deflector 152 and the completion deflector 154 to engage and exert a downwards force on the anchor component 156. In an embodiment, the axial hollow of the drilling deflector 152 aligns with the axial hollow of the completion deflector 154. In some contexts, the plug 114 of the retrieval tool 100 may be referred to as a member or an extended member.

In an embodiment, in a run-in state of the tool assembly 150, a collet 162 of the drilling deflector 152 is retained by a first collet groove 164 defined by the interior of the completion deflector 154. In the run-in state of the tool assembly 150, the shaft 160 extends into a lower portion of the drilling deflector 152 and props the collet 162 of the drilling deflector 152, coupling the drilling deflector 152 with the completion deflector 154. In another embodiment, however, the drilling deflector 152 may be retained by a different mechanism in the run-in state of the tool assembly 150.

In the run-in state of the tool assembly 150, the anchor component 156 may comprise a latch that mates with an anchor coupling secured in the wellbore. In another embodiment, however, the anchor component 156 may mate with and be secured by another apparatus secured in the wellbore, for example a packer or other securing device. Alternatively, in an embodiment the anchor component 156 may be adapted to be directly secured in the wellbore without coupling to other downhole components separate from the tool assembly 150. When upwards force is exerted on the anchor component 156, the anchor component 156 may release from the wellbore and may be withdrawn from the wellbore. When downwards force is exerted on the anchor component 156, the anchor component 156 may secure the anchor component 156 in the wellbore.

In an embodiment, the tool assembly 150 promotes first deflecting a cutting tool into the wall of the wellbore to cut a window and to initiate a lateral wellbore, next retrieving the drilling deflector 152 while at the same time shifting the completion deflector 154 into a position suitable for deflecting a completion tool into the window, and last deflecting a completion tool into the window. In an embodiment, retrieving the drilling deflector 152 may provide the motivation for shifting the completion deflector 154 into the position for deflecting the completion tool into the window, a position proximate to the window. In an embodiment, the completion deflector 154 may further promote deflecting a tool into the window to work in the lateral wellbore. In an embodiment, the tool assembly 150 saves a trip into the wellbore and a trip out of the wellbore when performing a lateral junction completion, for example a TAML Level 5 completion. In an embodiment, the drilling deflector 152 defines a second collet groove 166. In another embodiment, the drilling deflector 152 may define one or more recesses adapted to be captured by the retrieval tool 100. The tool assembly 150 further comprises a retaining ring 168 retained by a recess in the shaft 160.

In another embodiment, the drilling deflector 152 and the completion deflector 154 may be run-in together into the wellbore, the window may be cut in the wall of the wellbore casing, and the drilling deflector 152 may be retrieved from the wellbore. Thereafter a completion tool may be run-in on a workstring, the completion tool may engage the completion deflector 154, the workstring may be lifted, lifting the completion tool, and the completion tool lifting the completion deflector 154 to a position proximate to the window. The completion tool may then disengage the completion deflector 154, the workstring may lift the completion tool above the window, the workstring may then lower the completion tool, and the completion deflector 154 may then guide the completion tool into the window, for example to promote completion of a multilateral junction between the wellbore and the lateral wellbore.

It is a teaching of the present disclosure that the alignment of the drilling deflector 152 to guide a cutting tool into the wall of the wellbore to cut a window and to initiate a lateral wellbore, which may be referred to as a window cutting kick-off point, may be different from the alignment of the completion deflector 154 to guide a completion tool and/or other tools through the window, which may be referred to as a completion kick-off point. Thus, the window cutting kick-off point may be different from the completion kick-off point. The tool assembly 150 promotes shifting the completion deflector 154 into an effective completion kick-off point in the completion state of the tool assembly 150. In any case, when the drilling deflector 152 is in position to guide the cutting tool into the wall of the wellbore to cut the window, the drilling deflector 152 may be said to be proximate to the window, at least at the time that the window has been cut in the casing and before the drilling deflector 152 has been retrieved from the wellbore. Likewise, when the completion deflector 154 is in position to guide the completion tool into the window, the completion deflector 154 may be said to be proximate to the window.

In an embodiment, a retrieval tool, for example the retrieval tool 100, is deployed into the wellbore and is received by the tool assembly 150, engaging the second collet groove 166. For example, the catch 120 of the retrieval tool 100, for example a collet, is received by the second collet groove 166 and the catch 120 is actuated, for example the collet 162 is propped by the propping area 122 of the piston 112. In another embodiment, the retrieval tool 100 may couple to the second collet groove 166 using a different mechanism actuated by the piston 112, for example using a rotating eccentric cam mechanism, using a pin, or using other mechanisms that promote controllable radial expansion of a rigid structure to engage and retain a recess, a groove, or an interior ridge or rim of the drilling deflector 152. Correspondingly, in another embodiment, the catch 120 of the retrieval tool 100 may engage and retain the drilling deflector 152 by coupling to one or more recesses defined by an interior of the upper portion of the drilling deflector 152.

The retrieval tool 100, coupled to the workstring, lifts up and causes the drilling deflector 152 and the completion deflector 154 to move upwards, sliding over the shaft 160, the retainer 168 sliding within the interior of the lower portion of the completion deflector 154 until the retainer 168 is captured and retained by a retaining recess 170 defined by the interior of the lower portion of the completion deflector 154. In an embodiment, the engagement of the retainer 168 with the retaining recess 170 may depend upon a rotational alignment of the shaft 160 with the completion deflector 154. In an embodiment, the desired rotational alignment of the shaft 160 with the completion deflector 154 may be maintained by engagement of a longitudinal land defined by the outside of the shaft 160 with a longitudinal groove defined by the inside of the completion deflector 154. Alternatively, the desired rotational alignment of the shaft 160 with the completion deflector 154 may be maintained by engagement of a longitudinal land defined by the inside of the completion deflector 154 with a longitudinal groove defined by the outside of the shaft 160.

Figure 3:
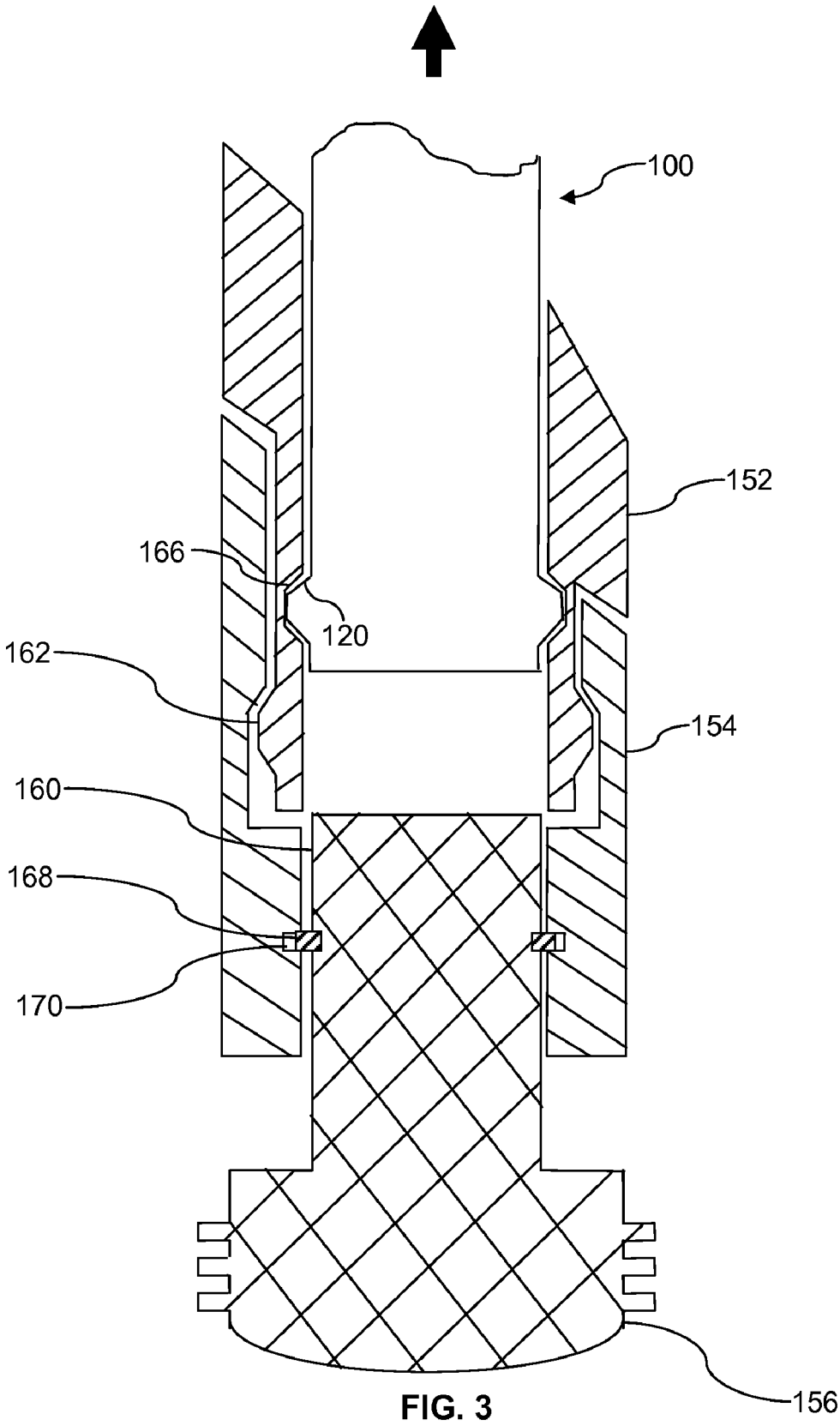
FIG. 3 illustrates the tool assembly coupled to the retrieval tool in a second state according to an embodiment of the disclosure.

While the retrieval tool 100 is lifting up on the drilling deflector 152 a component of the retrieval tool, for example the plug 114 of the retrieval tool 100, may exert downwards force on the anchor component 156, thereby maintaining engagement of the anchor component 156 with the anchor coupling or with the wellbore. In an embodiment, the tool assembly 150 is adapted to receive the downwards force exerted by the plug 114 of the retrieval tool 100. For example, the drilling deflector 152 and the completion deflector 154 may each define an axial hollow, aperture, or cavity through which the plug 114 may extend to engage the anchor component 156. When the completion deflector 154 has been moved upwards and the retainer 168 has been captured by the retaining recess 170, the completion deflector 154 is in position for deflecting a completion tool into the window. In this position, the tool assembly 150 may be said to be in a completion state. In the completion state, the drilling deflector 152 slides off of the shaft 1601 and the collet 162 of the drilling deflector 152 is unpropped. In the completion state, the completion deflector 154 may be said to release the drilling deflector 152. FIG. 3 illustrates the retrieval tool 100 lifting up on the tool assembly 150 and the tool assembly 150 in the completion state.

Figure 4:
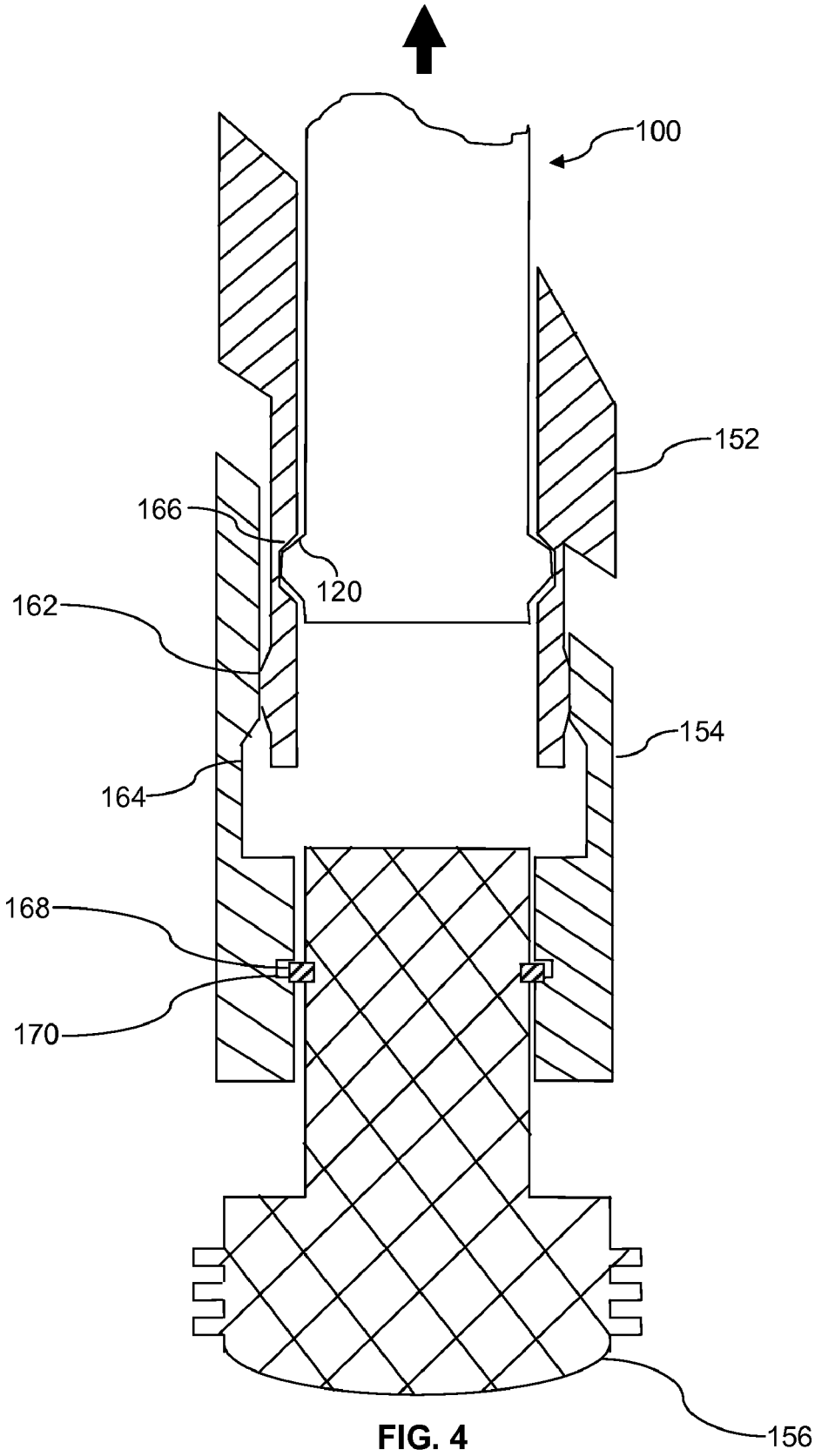
FIG. 4 illustrates the tool assembly coupled to the retrieval tool in a third state according to an embodiment of the disclosure.

The retrieval tool 100 continues to lift up and causes the collet 162 of the drilling deflector 152 to compress, allowing the collet 162 to release from the first collet groove 164 and to slide upwards, out of the completion deflector 154. While the retrieval tool 100 is lifting up on the drilling deflector 152, a component of the retrieval tool 100, for example the plug 114, may exert downwards force on the anchor component 156, thereby maintaining engagement of the anchor component 156 with the anchor coupling or with the wellbore. Once free of the completion deflector 154, the retrieval tool 100 may withdraw the drilling deflector 152 out of the wellbore. The retrieval tool 100 may be removed from the workstring, a completion tool coupled to the workstring, and the workstring run-in to perform the lateral junction completion, for example installing a screen apparatus or other apparatus in the window. FIG. 4 illustrates the retrieval tool 100 lifting up on the drilling deflector 152 and the collet 162 released from the first collet groove 164.

In another embodiment of the tool assembly 150, another mechanism may be employed by the completion deflector 154 to retain the drilling deflector 152 in the run-in state and to release the drilling deflector 152 after the tool assembly 150 has transitioned to the completion state. For example, an arrangement of a rotating eccentric cam coupled to a gear and further coupled to the completion deflector 154 may be provided where the gear coupled to the eccentric cam engages a linear toothed gear on the anchor component 156 such that the displacement of the drilling deflector 152 during the transition to the completion state of the tool assembly 150 causes the lobe of the cam to release the first collet groove 164. Similarly, in an embodiment, one or more pins may be biased to retract when the tool assembly 150 is in the completion state, releasing the first collet groove 164 and thus releasing the drilling deflector 152.

Figure 5:
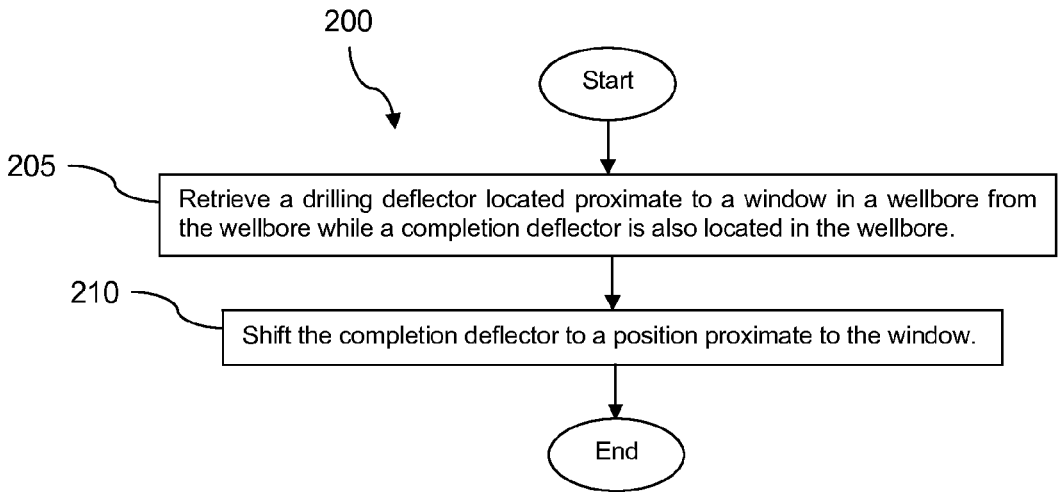
FIG. 5 illustrates a method of servicing a wellbore according to an embodiment of the disclosure.

Turning now to FIG. 5, a method 200 of servicing a wellbore is described. At block 205, the drilling deflector 152, located proximate to the window in the wellbore, is removed from the wellbore, while the completion deflector 154 is also located in the wellbore. At block 210, the completion deflector 154 is shifted to a position proximate to the window. In different embodiments, different causes may shift the completion deflector 154 to the position proximate to the window. In one embodiment, retrieving the drilling deflector 152 motivates the shifting of the completion deflector 154. For example, the drilling deflector 152 and the completion deflector 154 may be coupled to each other in such a way that the action of retracting the drilling deflector 152, at least a first portion of the retraction of the drilling deflector 152, moves the completion deflector 154 into the position proximate to the window. In an embodiment, a portion of the drilling deflector 152 may nest within a portion of the completion deflector 154.

In an embodiment, the method 200 may further comprise the completion deflector 154 retaining the drilling deflector 152 after run-in of the drilling deflector 152 and before the completion deflector 154 is shifted to the position proximate to the window. In an embodiment, the method 200 further comprises the completion deflector 154 releasing the drilling deflector 152 when the completion deflector 154 is shifted to the position proximate to the window. In an embodiment, the method 200 may further comprise the anchor component 156 retaining the completion deflector 154 when the completion deflector 154 is shifted to the position proximate to the window. In an embodiment, retaining the completion deflector 154 comprises the anchor component 156 propping the collet 162 of the drilling deflector 152. In an embodiment, retrieving the drilling deflector 152 may comprise applying upwards force on the drilling deflector 152 while applying downwards force to the anchor component 156.

Figure 6:
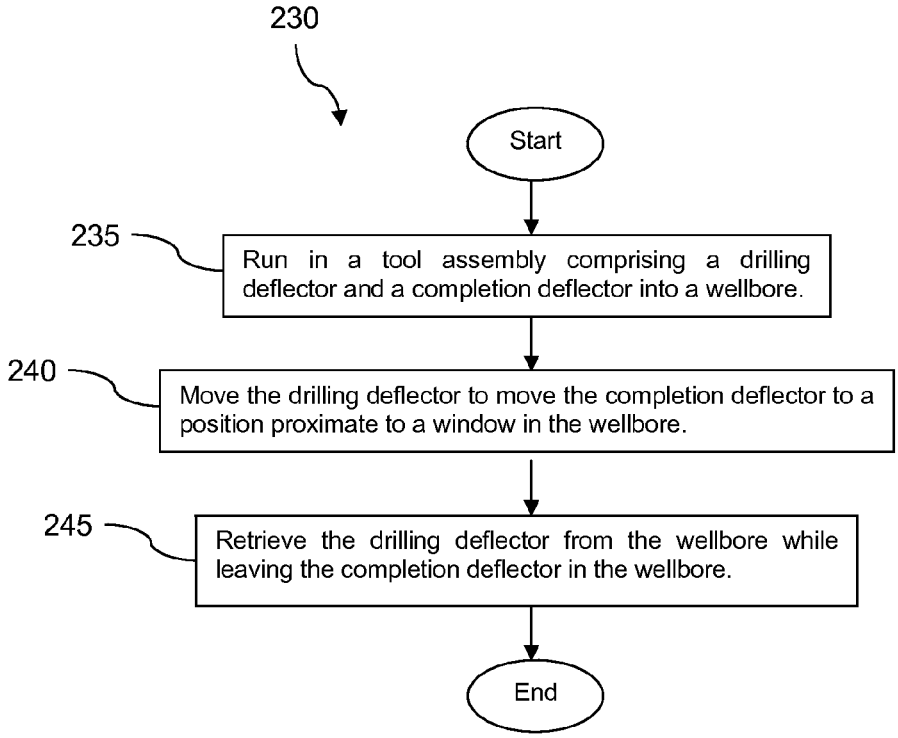
FIG. 6 illustrates another method of servicing a wellbore according to an embodiment of the disclosure.

Turning now to FIG. 6, a method 230 of servicing a wellbore is described. At block 235, a tool assembly comprising the drilling deflector 152 and the completion deflector 154 are run into the wellbore. In an embodiment, the tool assembly may further comprise the anchor component 156, but in another embodiment, the tool assembly does not comprise the anchor component 156. At block 240, the drilling deflector 152 is moved to move the completion deflector 154 to a position proximate to the window in the wellbore. For example, in an embodiment, the drilling deflector 152 is coupled to the completion deflector 154 in the run-in state of the tool assembly, and moving the drilling deflector 152 correspondingly moves the completion deflector 154. In an embodiment, the coupling between the drilling deflector 152 and the completion deflector 154 is removed or released when the completion deflector 154 is moved to the position proximate to the window.

At block 245, the drilling deflector 152 is retrieved from the wellbore while the completion deflector 154 is left in the wellbore. In an embodiment, the tool assembly further comprises the anchor component 156, and retrieving the drilling deflector 152 comprises a retrieval tool retaining the drilling deflector 152, the retrieval tool extending a member—for example the plug 114 of the retrieval tool 100—through the drilling deflector 152 and the completion deflector 154, and the retrieval tool exerting downwards force on the anchor component 156 via the member on the anchor component 156. In another embodiment, however, the action of block 240 does not occur, the drilling deflector 152 and the completion deflector 154 are not coupled, and the completion deflector 154 is moved into a position proximate to the window by an interaction with a completion tool attached to a workstring, before the completion tool is guided into the window by the completion deflector 154.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A tool assembly, comprising:

a drilling deflector; and a completion deflector coupled to the drilling deflector, wherein the coupling between the drilling deflector and the completion deflector comprises a portion of the drilling deflector nesting within a portion of the completion deflector, and wherein an interior of the completion deflector defines a first recess and wherein the drilling deflector comprises a catch that engages the first recess in a run-in state of the tool assembly and that releases from the first recess when in a completion state of the tool assembly.

2. The tool assembly of claim 1, wherein the catch comprises one of a collet, an eccentric cam, and a pin.

3. The tool assembly of claim 1, wherein the drilling deflector comprises an axial hollow, wherein the completion deflector comprises an axial hollow, and wherein the axial hollow of the drilling deflector aligns with the axial hollow of the completion deflector.

4. The tool assembly of claim 1, wherein the tool assembly further comprises an anchor coupled to the completion deflector.

5. The tool assembly of claim 4, further comprising a retainer, wherein an exterior of the anchor comprises a second recess, wherein the interior of the completion deflector comprises a third recess, and wherein the retainer is captured by the second recess and the third recess in a completion state of the tool assembly.

6. A method of servicing a wellbore, comprising:

retrieving a drilling deflector located proximate to a window in the wellbore from the wellbore while a completion deflector is also located in the wellbore; and shifting the completion deflector to a position proximate to the window, wherein a portion of the drilling deflector is nested within a portion of the completion deflector before retrieving the drilling deflector and wherein shifting the completion deflector to the position proximate to the window is motivated by retrieving the drilling deflector.

7. A method of servicing a wellbore, comprising:

retrieving a drilling deflector located proximate to a window in the wellbore from the wellbore while a completion deflector is also located in the wellbore;

shifting the completion deflector to a position proximate to the window;

retaining, by the completion deflector, the drilling deflector after run-in of the drilling deflector and before the completion deflector is shifted to the position proximate to the window; and releasing, by the completion deflector, the drilling deflector when the completion deflector is shifted to the position proximate to the window.

8. A method of servicing a wellbore, comprising:

retrieving a drilling deflector located proximate to a window in the wellbore from the wellbore while a completion deflector is also located in the wellbore;

shifting the completion deflector to a position proximate to the window; and retaining, by an anchor component, the completion deflector when the completion deflector is shifted to the position proximate to the window.

9. The method of claim 8, wherein retrieving the drilling deflector comprises applying upwards force on the drilling deflector while downwards force is applied to the anchor component.

10. The method of claim 8, wherein the completion deflector retaining the drilling deflector comprises the anchor component propping a collet of the drilling deflector.

11. A method of servicing a wellbore, comprising:

running a tool assembly comprising a drilling deflector and a completion deflector into the wellbore;

retrieving the drilling deflector from the wellbore while leaving the completion deflector in the wellbore; and moving the drilling deflector to move the completion deflector to a position proximate to a window in the wellbore.

12. The method of claim 11, further comprising retaining, by a retrieval tool, the drilling deflector by actuating a catch of the retrieval tool to engage a recess defined by the drilling deflector.

13. The method of claim 11, wherein retrieving the drilling deflector comprises retaining, by the completion deflector, the drilling deflector during a first portion of retrieving the drilling deflector and comprises releasing, by the completion deflector, the drilling deflector during a second portion of retrieving the drilling deflector.

14. A method of servicing a wellbore, comprising:

running a tool assembly comprising a drilling deflector and a completion deflector into the wellbore; and retrieving the drilling deflector from the wellbore while leaving the completion deflector in the wellbore, wherein the tool assembly further comprises an anchor component and wherein retrieving the drilling deflector comprises a retrieval tool retaining the drilling deflector, the retrieval tool extending a member through the drilling deflector and the completion deflector, and the retrieval tool exerting downwards force via the member on the anchor.

15. A method of servicing a wellbore, comprising:

running a tool assembly comprising a drilling deflector and a completion deflector into the wellbore;

retrieving the drilling deflector from the wellbore while leaving the completion deflector in the wellbore; and shifting the drilling deflector and the completion deflector together upwards.

16. The method of claim 15, wherein a portion of the drilling deflector nests within the completion deflector while running the tool assembly into the wellbore and further comprising unnesting the portion of the drilling deflector from the completion deflector after the completion deflector has been shifted into a position proximate to a window in the wellbore.

* * * * *